US011606846B2

(12) United States Patent
Stura et al.

(10) Patent No.: US 11,606,846 B2
(45) Date of Patent: Mar. 14, 2023

(54) AEROSOL GENERATING DEVICE WITH INDUCTION HEATER WITH SIDE OPENING

(71) Applicant: Philip Morris Products S.A., Neuchatel (CH)

(72) Inventors: Enrico Stura, Palezieux-Village (CH); Oleg Mironov, Cudrefin (CH); Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 490 days.

(21) Appl. No.: 16/637,471

(22) PCT Filed: Aug. 6, 2018

(86) PCT No.: PCT/EP2018/071259
§ 371 (c)(1),
(2) Date: Feb. 7, 2020

(87) PCT Pub. No.: WO2019/030166
PCT Pub. Date: Feb. 14, 2019

(65) Prior Publication Data

US 2020/0237001 A1 Jul. 30, 2020

(30) Foreign Application Priority Data

Aug. 9, 2017 (EP) ..... 17185548

(51) Int. Cl.
*H05B 6/10* (2006.01)
*A24F 40/465* (2020.01)
(Continued)

(52) U.S. Cl.
CPC ..... *H05B 6/108* (2013.01); *A24F 40/465* (2020.01); *A24F 40/485* (2020.01); *A24F 40/85* (2020.01); *H05B 6/36* (2013.01); *A24F 40/20* (2020.01)

(58) Field of Classification Search
CPC ..... A24F 40/20; A24F 40/465; A24F 40/468; A24F 40/85; H05B 6/108; H05B 6/36
See application file for complete search history.

(56) References Cited

U.S. PATENT DOCUMENTS

2015/0305408 A1 10/2015 Liu
2016/0014851 A1* 1/2016 Gough ..... H05B 6/36 140/710

(Continued)

FOREIGN PATENT DOCUMENTS

CN 1207235 A 2/1999
CN 204560964 U 8/2015

(Continued)

OTHER PUBLICATIONS

International Search Report and Written Opinion dated Nov. 13, 2018 in PCT/EP2018/071259 filed on Aug. 6, 2018.

(Continued)

*Primary Examiner* — Dana Ross
*Assistant Examiner* — Joe E Mills, Jr.
(74) *Attorney, Agent, or Firm* — Oblon, McClelland, Maier & Neustadt, L.L.P.

(57) ABSTRACT

An aerosol-generating device is provided, including: an induction heater configured to heat an aerosol-forming substrate and including an induction coil and a heating element, the heating element being arrangeable within the induction coil, the induction coil including a first side opening along a longitudinal length of the induction coil, and the first side opening being configured to enable access to the heating element; and a housing, the induction coil being arranged within the housing, and the housing including a second side opening, which corresponds to the first side opening of the induction coil within the housing. A method for manufacturing the aerosol-generating device is also provided.

14 Claims, 8 Drawing Sheets

(51) Int. Cl.

| | |
|---|---|
| ***H05B 6/36*** | (2006.01) |
| ***A24F 40/485*** | (2020.01) |
| ***A24F 40/85*** | (2020.01) |
| ***A24F 40/20*** | (2020.01) |

(56) References Cited

U.S. PATENT DOCUMENTS

| | | | | |
|---|---|---|---|---|
| 2017/0055580 | A1* | 3/2017 | Blandino ..... | H05B 6/36 |
| 2017/0055585 | A1 | 3/2017 | Fursa et al. | |
| 2017/0055587 | A1 | 3/2017 | Zinovik et al. | |
| 2017/0172208 | A1 | 6/2017 | Mironov | |
| 2018/0070639 | A1 | 3/2018 | Chen et al. | |
| 2018/0263294 | A1 | 9/2018 | Qiu et al. | |

FOREIGN PATENT DOCUMENTS

| | | | |
|---|---|---|---|
| CN | 105286091 | A | 2/2016 |
| CN | 206227716 | U | 6/2017 |
| RU | 2 517 100 | C2 | 5/2014 |
| RU | 2 517 125 | C2 | 5/2014 |
| WO | WO 97/25835 | A1 | 7/1997 |
| WO | WO 2015/177255 | A1 | 11/2015 |
| WO | WO 2017/068094 | A1 | 4/2017 |

OTHER PUBLICATIONS

Combined Chinese Office Action and Search Report dated Dec. 30, 2021 in Corresponding Chinese Patent Application No. 201880050916.4 (submitting English translation only), 9 pages.

Russian Federation Office Action dated Oct. 16, 2020 in Patent Applicaton No. 2020105766/03(008829), (submitting English translation only), 6 pages.

Japanese Office Action dated Jan. 28, 2021 in Patent Application No. 2020-506980, (submitting English translation only), 2 pages.

* cited by examiner

AEROSOL GENERATING DEVICE WITH INDUCTION HEATER WITH SIDE OPENING

The present invention relates to an aerosol-generating device comprising an induction heater with an induction coil and the heating element. The heating element is arrangeable within the induction coil.

It is known to employ different types of heaters in aerosol-generating articles for generating an aerosol. Typically, resistance heaters are employed for heating an aerosol-forming substrate such as an e-liquid. It is also known to provide "heat not burn" devices utilizing resistance heaters, which generate an inhalable aerosol by heating but not burning an aerosol-forming substrate containing tobacco.

Induction heaters offer advantages and have been proposed in the above devices. Induction heaters are for example described in US 2017/055580 A1. In induction heaters, an induction coil is arranged around a component made from a conductive material. The component may be denoted as heating element or susceptor. A high-frequency AC current is passed through the induction coil. As a result, an alternating magnetic field is created within the induction coil. The alternating magnetic field penetrates the heating element thereby creating eddy currents within the heating element. These currents lead to a heating of the heating element. In addition to heat generated by eddy currents, the alternating magnetic field may also cause the susceptor to heat due to the hysteresis mechanism. Some susceptors may even be of a nature that no, or almost no, eddy currents will take place. In such susceptors substantially all the heat generation is due to hysteresis mechanisms. Most common susceptors are of such a kind, where heat is generated by both mechanisms. A more elaborate description of the processes and responsible for generating heat in a susceptor, when penetrated by an alternating magnetic field may be found in WO2015/177255. Inductive heaters facilitate rapid heating which is beneficial for generating an aerosol during the operation of the aerosol-generating device.

It would be desirable to have an aerosol-generating device with an induction heater in which the heating element can be easily assessed for cleaning or replacement.

According to a first aspect of the invention there is provided an aerosol-generating device, comprising an induction heater for heating an aerosol-forming substrate. The induction heater comprises an induction coil and a heating element, wherein the heating element is arrangeable within the induction coil. The induction coil comprises a side opening along the longitudinal length of the induction coil. The side opening is configured for enabling an access to the heating element. The aerosol-generating device may further comprise a housing, wherein the induction coil may be arranged within the housing, and wherein the housing may comprise a side opening which corresponds to the side opening of the induction coil within the housing.

The side opening may have the shape of a slit extending the full longitudinal length of the coil. The induction coil may have a C-shaped cross-section perpendicular to a longitudinal axis of the coil.

The side opening enables access to the heating element which is arranged within the induction coil. In this way cleaning of the heating element may be improved. For example, a cleaning tool such as a small brush may be introduced into the side opening to clean the heating element. Alternatively, the heating element may be removed from the aerosol-generating device through the side opening in the induction coil. The heating element may be replaceable through the side opening.

Aerosol-forming substrate containing tobacco may be provided in the form of an aerosol-generating article. The aerosol-generating article may be provided as a consumable such as a tobacco stick. In the following, the aerosol-generating article will be denoted as a consumable. These consumables may have an elongate rod-like shape. Such a consumable is typically pushed into a recess of the device. In the recess, the heating element of the induction heater is configured to penetrate the consumable. Once the aerosol-forming substrate in the consumable is depleted after multiple heating cycles of the induction heater, the consumable is removed and replaced by a new consumable. Upon removing the depleted consumable, residues of depleted aerosol-forming substrate may stick to the heating element and impair the functionality of the heating element. Such residues may affect subsequent aerosol generation and are thus unwanted. By providing a side opening in the induction coil, removal of the residues is facilitated.

As a further advantage, a user may identify through the side opening whether or not the consumable has been correctly placed inside of the device.

The side opening may have a width which is larger than the diameter of the heating element when the heating element has a circular cross section. The side opening may have a width which is larger than the width of heating element when the heating element has a circular or non-circular cross section. The heating element may thus be cleaned or removed through the side opening.

The aerosol-generating device may further comprise a housing, wherein the induction coil is arranged within the housing. In this way the induction coil is protected by the housing. The induction coil may be formed integrally within walls of the housing or located adjacent to inner walls of the housing. The housing comprises a side opening which corresponds to the side opening of the induction coil within the housing. The side openings of the housing and the coil align such that the heating element may be assessable through the side opening in the housing.

The aerosol-generating device may further comprise a power supply for supplying power to the induction coil of the induction heater and a controller for controlling the supply of power from the power supply to the induction coil of the induction heater.

The side opening may also be configured as the air inlet. The ambient air may subsequently be channeled towards the heating element and may be inhaled through an inserted consumable. No additional air inlet may be necessary for introducing air into the device.

The side opening may have a shape which enables a cleaning tool to be inserted into the side opening. The side opening may be dimensioned corresponding to the shape of the cleaning tool. Preferably, the side opening has a vertical slit-like shape corresponding to the length of the heating element. This shape allows a cleaning tool to access the full length of the heating element in order to clean it.

The heating element and coil may have a predefined length. The heating element may have the same length as the coil. The heating element may have the shape of a pin or blade. The heating element may be solid while the coil may have a helical shape such that the heating element can be arranged within the coil. The coil may be provided as a helical wound coil with the shape of a helical spring. The coil may comprise contact elements such that an AC current can flow through the coil from the power supply. The AC current supplied to the induction coil is preferably a high frequency AC current. For the purpose of this application, the term "high frequency" is to be understood to denote a frequency ranging from about 1 Megahertz (MHz) to about 30 Megahertz (MHz) (including the range of 1 MHz to 30 MHz), in particular from about 1 Megahertz (MHz) to about 10 MHz (including the range of 1 MHz to 10 MHz), and even more particularly from about 5 Megahertz (MHz) to about 7 Megahertz (MHz) (including the range of 5 MHz to 7 MHz). No direct or electrical connection needs to be established between the coil and the heating element, since the magnetic field generated by the coil penetrates the heating element and thereby creates the eddy currents. The eddy currents are converted into heat energy. The coil as well as the heating element may be made from a conductive material such as metal. The heating element and the coil may have a circular, elliptical or polygonal shaped cross-section. The induction coil may be arranged in the housing of the device. The housing may constitute the confinement for the coil. The housing may be made from a non-conductive material such that no eddy currents are generated in the second housing portion, and which is also not heatable through hysteresis mechanisms. In other words, the housing may be made from a non-susceptor material, for example a non-conductive, non-susceptor material. The whole housing of the device may be made from a non-conductive material. Alternatively, the housing adjacent to the induction coil may be made from a non-conductive material.

The side opening of the housing may have a shape which allows the heating element to be inserted and removed through the side opening of the housing. The heating element may comprise a base section and a heating section, wherein the heating element may be configured to be slidably insertable through the side opening of the housing to a position within the induction coil. The base section and the heating section may be integrally formed. The base section and the heating section may be made from the same material. The side opening of the housing may have a shape that enables the base section as well as the heating section of the heating element to pass through the side opening of the housing. The shape of the side opening of the housing may preferably be an inverted T-shape to allow the elongate heating section and the base section, which preferably extends perpendicular to the longitudinal axis of the heating section, to pass through the side opening of the housing.

Adjacent to the side opening of the housing, a guiding element may be provided in the housing for guiding the base section of the heating element during insertion into the housing. A holding element may be provided in the housing to hold the base section inside of the housing after insertion of the base section.

The base section of the heating element may comprise a tab, preferably a colorized tab, that remains visible after the heating element has been inserted into the housing. The tab may be arranged at a side face of the base of the heating element such that the tab is visible from the outside even if the heating element is inserted through the side opening of the housing into the aerosol-generating device. The tab may enable a consumer to identify that the heating element is present in the aerosol-generating device and may enable the consumer to identify the type of heating element inserted in the aerosol-generating device. The tab or the base section or the tab and the base section may be gripped by the user for removing the base section and the heating element through the side opening.

The base section may be made from a thermally insulating material. In this way, a consumer may remove or touch the base section of the heating element without the base section becoming too hot.

The base section may be made from an electrically non-conductive material. No eddy currents may thus be generated in the base section of the heating element during operation of the induction heater such that a heating of the base section may be prevented. The base section may be made from a thermally insulating and electrically non-conductive material.

Different heating elements of different lengths may be used with the same device. The different lengths enable different heating regimes of the induction heater. A longer heating element generates more heat and also penetrates deeper within the consumable, while a shorter heating element generates less heat and also penetrates less deep within the consumable. Depending upon the desired heating regime, the user may change the heating element through the side opening. The side opening may have a length which is sufficiently long for enabling heating elements of different lengths to be introduced through the side opening. Different tab colors may indicate heating elements of different length.

The housing of the device may comprise a controller. The controller may comprise a microprocessor, which may be a programmable microprocessor. The controller may comprise further electronic components. The controller may be configured to regulate a supply of electric power to the induction heater. Electric power may be supplied to the induction heater continuously following activation of the device or may be supplied intermittently, such as on a puff-by-puff basis. The power may be supplied to the induction heater in the form of pulses of electrical current.

The device may comprise a power supply, typically a battery, within the housing. As an alternative, the power supply may be another form of charge storage device such as a capacitor. The power supply may require recharging and may have a capacity that allows for the storage of enough energy for one or more puffs; for example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction heater.

The aerosol-forming substrate may comprise homogenized tobacco material. The aerosol-forming substrate may comprise an aerosol-former. The aerosol-forming substrate preferably comprises homogenized tobacco material, an aerosol-former and water. Providing homogenized tobacco material may improve aerosol generation, the nicotine content and the flavour profile of the aerosol generated during heating of the aerosol-generating article. Specifically, the process of making homogenized tobacco involves grinding tobacco leaf, which more effectively enables the release of nicotine and flavours upon heating.

The induction heater may be triggered by a puff detection system. Alternatively, the induction heater may be triggered by pressing an on-off button, held for the duration of the user's puff.

The puff detection system may be provided as a sensor, which may be configured as an airflow sensor and may measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor to measure the pressure of the air inside the aerosol-generating device which is drawn through the airflow path of the device by the user during a puff.

An aerosol-generating device as described above and a consumable may be an electrically operated smoking system. Preferably, the aerosol-generating system is portable. The aerosol-generating system may have a size comparable to a conventional cigar or cigarette. The smoking system may have a total length between approximately 30 millimetres and approximately 150 millimetres. The smoking system may have an external diameter between approximately 5 millimetres and approximately 30 millimetres.

The invention is further related to a method for manufacturing an aerosol-generating device, comprising the following steps:

providing an induction heater for heating an aerosol-forming substrate, the induction heater comprising an induction coil and a heating element, wherein the heating element is arrangeable within the induction coil, wherein the induction coil comprises a side opening along the longitudinal length of the induction coil, and wherein the side opening is configured for enabling access to the heating element.

The invention will be further described, by way of example only, with reference to the accompanying drawings in which.

Figure 1:
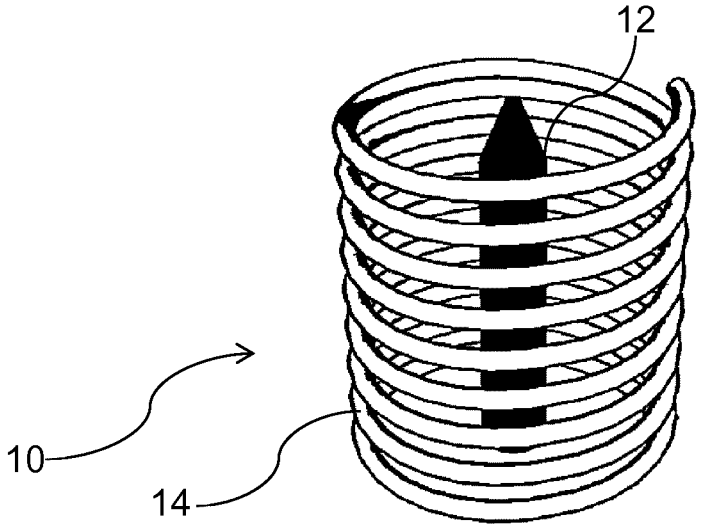
FIG. 1 shows a conventional induction heater.

FIG. 1 shows a conventional induction heater 10 with an elongate heating element 12 that is arranged within an induction coil 14. The elongate heating element 12 has a tapered tip for facilitating the insertion of a consumable.

Figures 2, 2A, 2B, 2C:
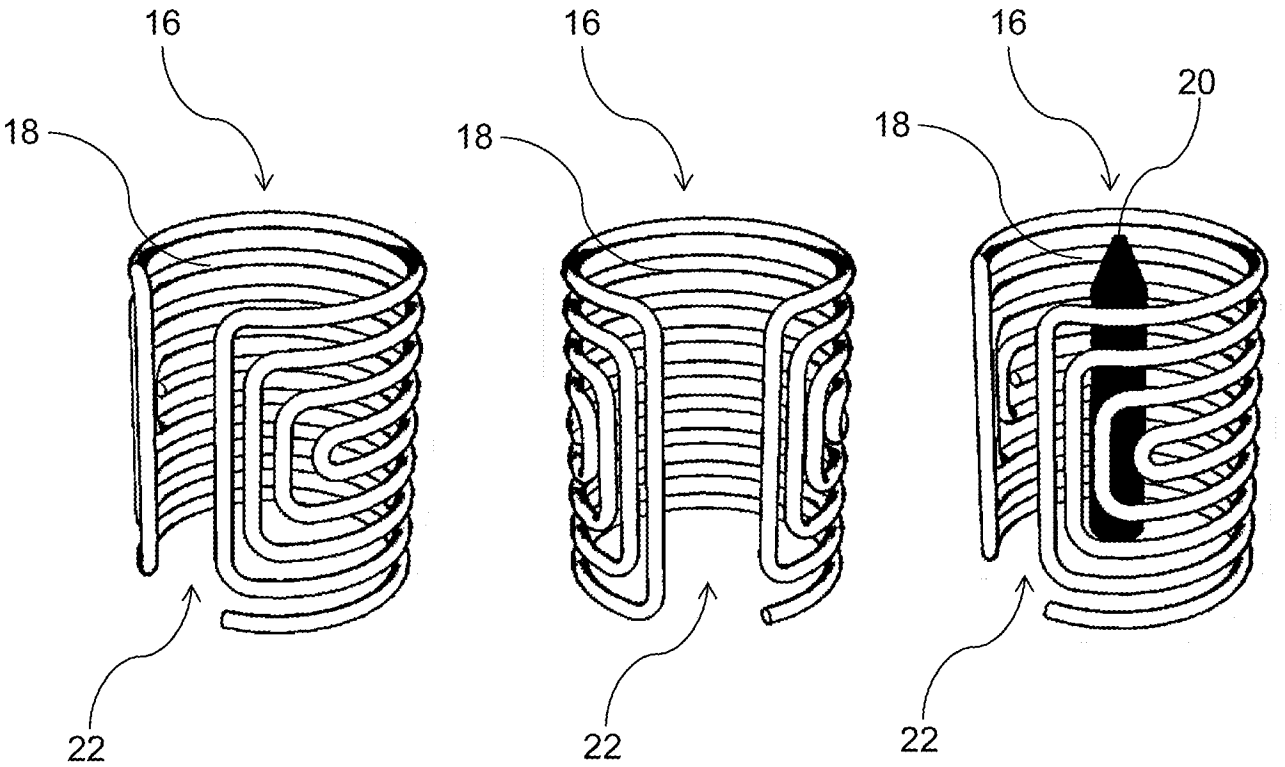
FIG. 2 shows induction heater with an induction coil with a side opening along the longitudinal length according to the invention.

FIG. 2 shows an induction heater 16 according to the invention comprising an induction coil 18 and a heating element 20. The induction coil 18 has been modified with respect to a conventional induction coil as depicted in FIG. 1 such that a side opening 22 is provided along the full longitudinal length of the induction coil 18. FIG. 2*c* shows the heating element 20 being arranged within the induction coil 18. The width of the side opening 22 is larger than the diameter of the heating element 20, so that the heating element 20 can be inserted through the side opening 22 into the induction coil 18.

Through the side opening 22, a cleaning tool can be inserted for cleaning the heating element 20. The heating element 20 can be removed from within the induction coil 18. The side opening 22 is relatively narrow such that the generation of a magnetic field by the induction coil 18 is not significantly deteriorated. The side opening 22 has a width which is slightly larger than the diameter of the heating element 20. As can be seen in FIG. 2, the windings of the induction coil 18 are U-shaped to facilitate that a single wire can be used for forming the induction coil 18 with a side opening 22. The ends of the wire can be contacted for directing an AC current through the induction coil 18.

Figure 3:
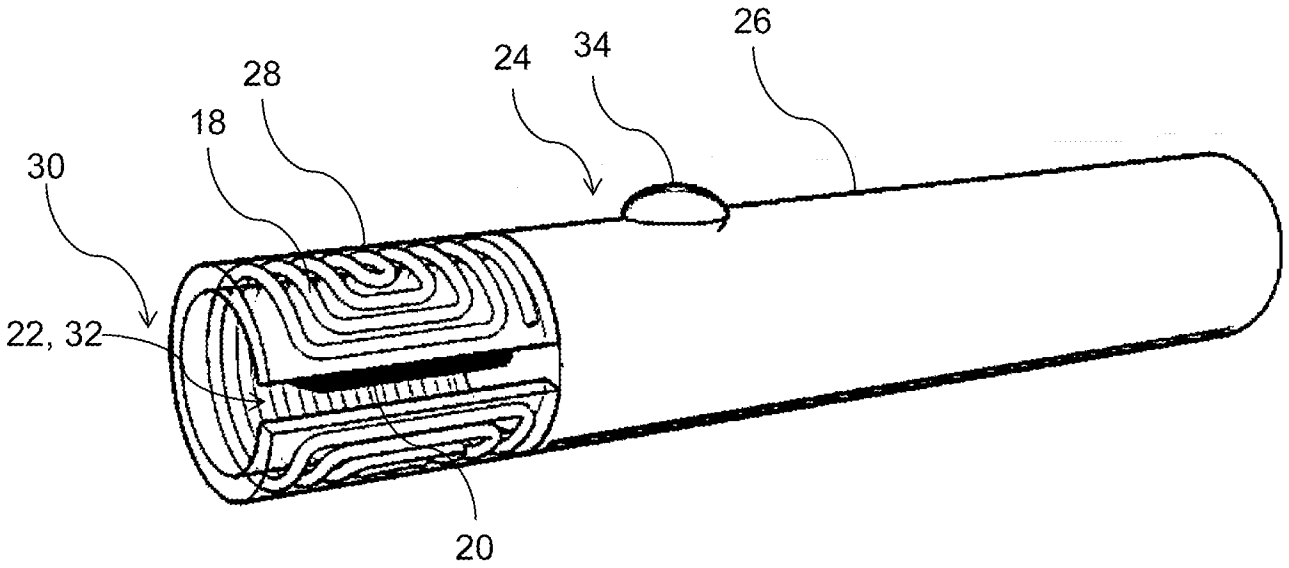
FIG. 3 shows the induction heater of FIG. 2 in an aerosol-generating device.

FIG. 3 shows the induction heater 16 as depicted in FIG. 2 arranged in an aerosol-generating device 24. The aerosol-generating device 24 comprises a first housing portion 26 which comprises a power source such as a battery and a controller for controlling the flow of electrical energy from the power source to the induction coil 18 of the induction heater 16. At a proximal end 30 of the aerosol-generating device 24, a second housing portion 28 is arranged and the induction coil 18 is arranged within the second housing portion 28. The consumable is inserted into a recess 38 at the proximal end 30 of the device 24. The second housing portion 28 is provided for protecting the induction coil 18 from being contaminated or damaged. FIG. 3 shows a side opening 32 in the second housing portion 28. The side opening 32 in the second housing portion 28 corresponds to the side opening 22 in the induction coil 18. In this way, the heating element 20 within the induction coil 18 and within the second housing portion 28 can be assessed through the side opening 32. FIG. 3 also shows a button 34 for activating the induction heater 16.

In FIG. 3, the second housing portion 28 is depicted transparent such that the arrangement of the induction coil 18 within the the second housing portion 28 can be seen.

Figures 4, 4A, 4B:
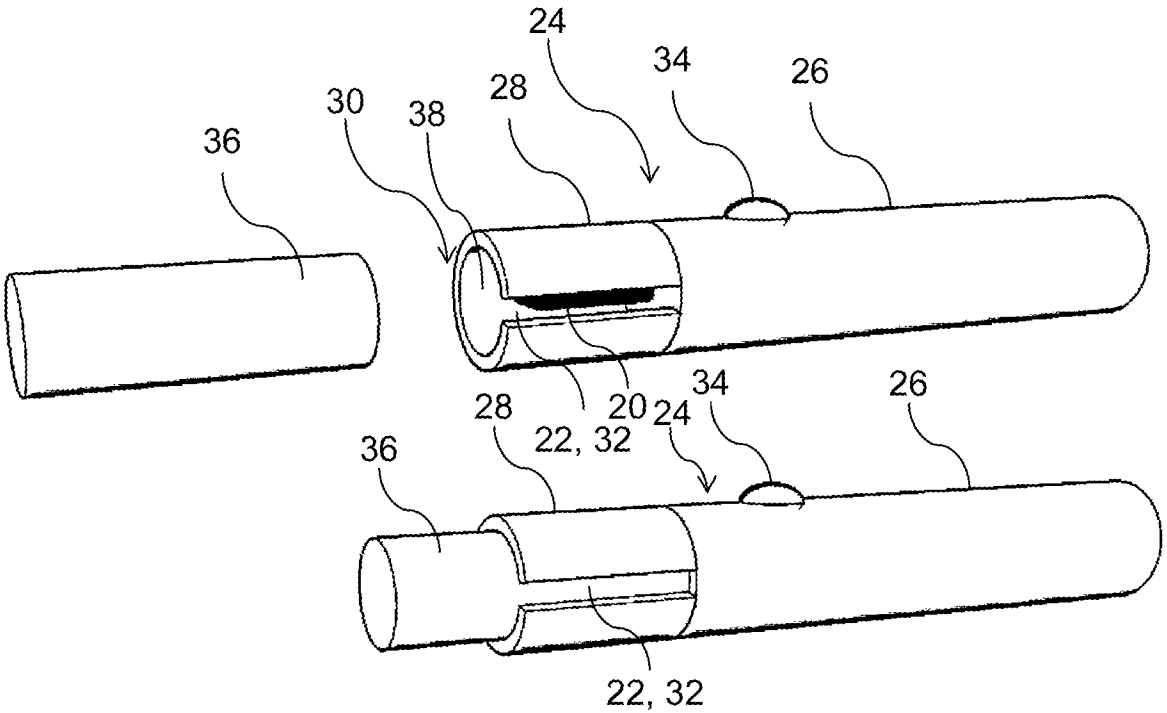
FIG. 4 shows the aerosol-generating device with an inserted consumable.

FIG. 4 shows a consumable 36 being inserted at the proximal end 30 into a recess 38 in the second housing portion 28. In FIG. 4*a*, the consumable 36 is not yet being inserted into the recess 38, while in FIG. 4*b*, the consumable 36 is inserted into the recess 38.

Figures 5, 5A, 5B, 5C:
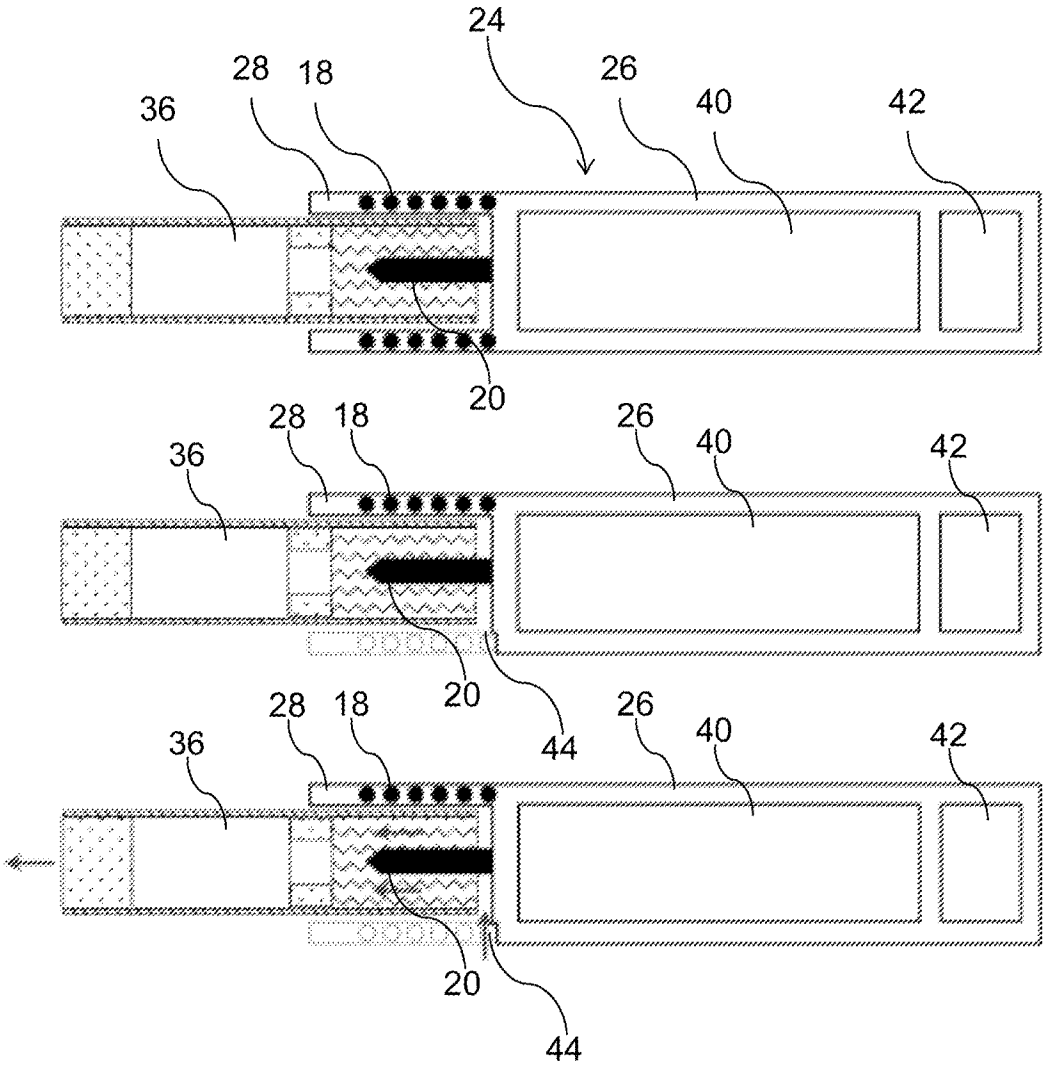
FIG. 5 shows the aerosol-generating device with different air inlets.

FIG. 5 shows an illustrative sectional view of the aerosol-generating device 24, wherein a battery 42 as well as a controller 44 are depicted in the first housing portion 26. In FIGS. 5*b* and 5*c*, an air inlet 44 is depicted, wherein the air inlet 44 is realized by the side opening 22, 32. Ambient air can be drawn into the device through the side opening 22, 32 and expelled through the consumable 36 next to the heating element 20 as indicated by the arrows in FIG. 5*c*.

Figure 6:
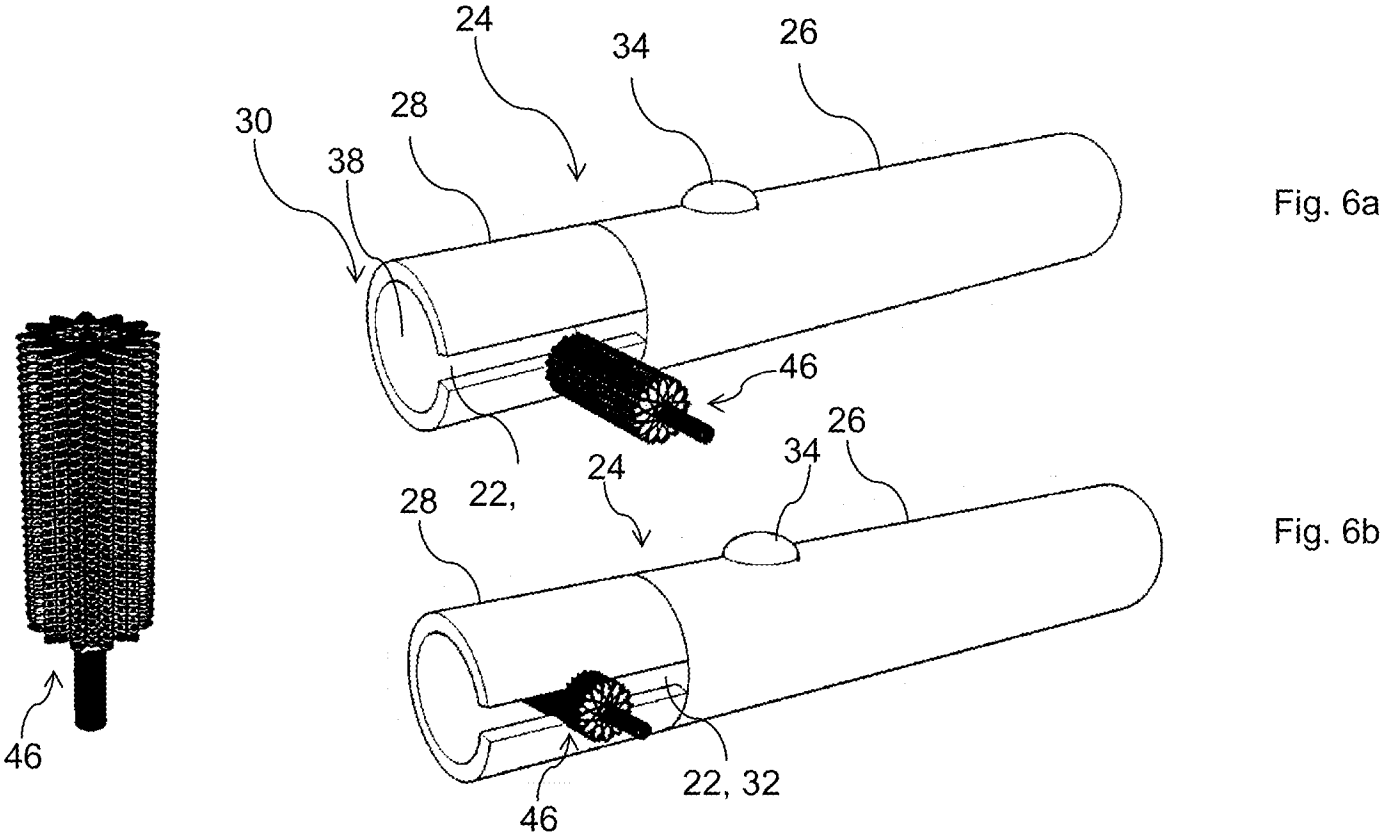
FIG. 6 shows the aerosol-generating device together with a cleaning tool.

FIG. 6 shows a cleaning tool 46, which can be inserted into the side opening 22, 32 for cleaning the heating element 20. In this regard, FIG. 6*a* shows the cleaning tool 46 being arranged to be inserted into the side opening 22, 32 and FIG. 6*b*, shows the cleaning tool 46 being inserted into the side opening 22, 32.

Figure 7:
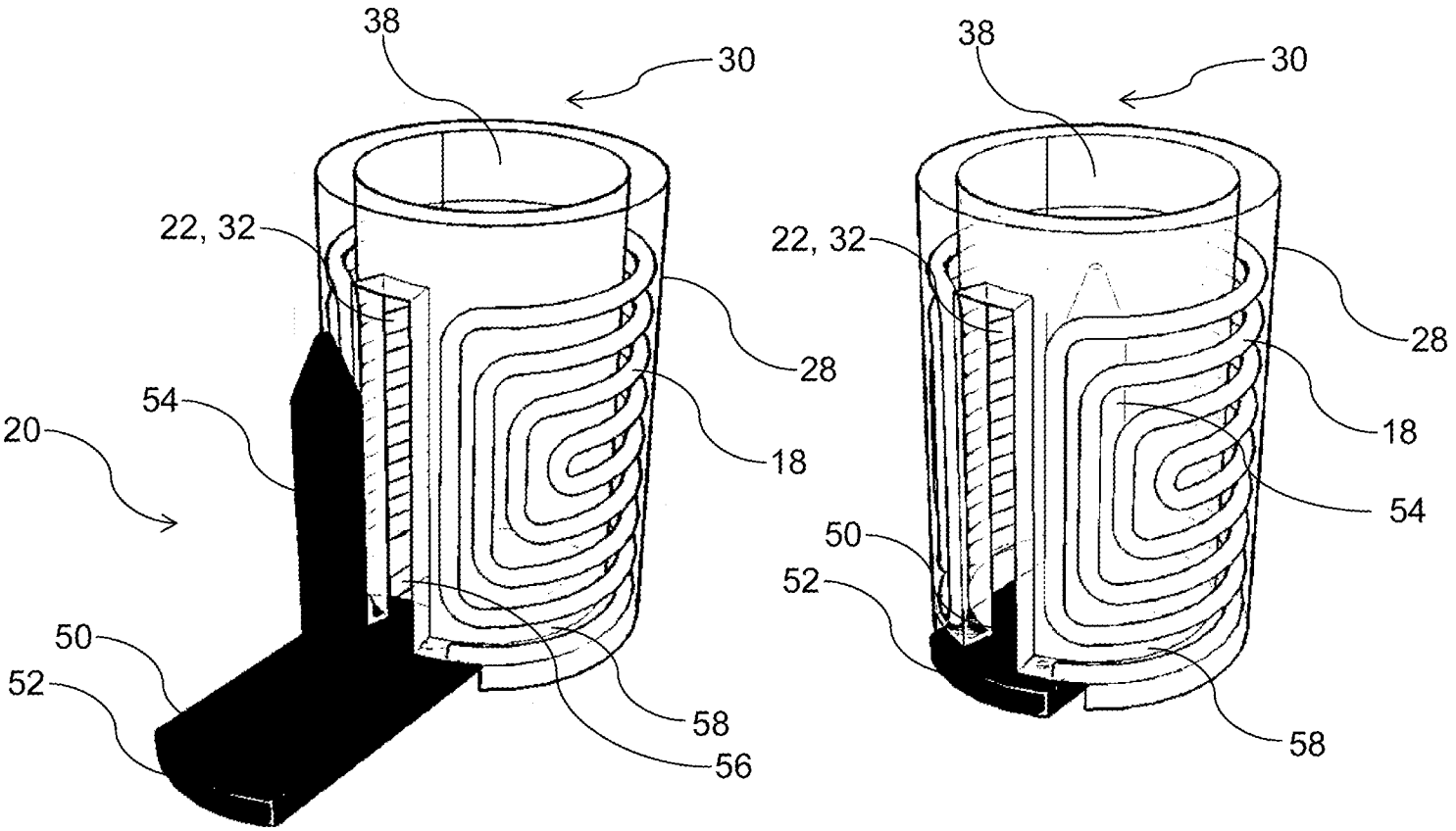
FIG. 7 shows the aerosol-generating device with the heating element comprising a sliding base section insertable into the device.

FIG. 7 shows a further embodiment, in which the side opening 32 in the second housing portion 28 does not extend along the full length of the second housing portion 28 such that the second housing portion 28 is fully closed at the proximal end 30. Also, at a distal section of the side opening 32, a further slit 48 is provided which extends perpendicular to the longitudinal axis of the side opening 32. The slit 48 is provided such that a modified heating element 20 comprising a base section 50 can be inserted into the second housing portion 28 through the side opening 32 comprising the slit 48. The base section 50 is made from a thermally and electrically non-conductive material such that it can be gripped directly after operating the induction heater 16. The base section 50 is configured as a sliding element. The base section 15 is provided with a colored tab 52. The colored tab 52 enables the identification that the heating element 20 is provided inside of the second housing portion 28 and which kind of heating element 20 is provided inside of the second housing portion 28. The heating element 20 comprises an elongate solid heating section 54 made from an electrically conductive material.

In FIG. 7, a guiding element 56 is provided at a base portion 58 of the second housing portion 28 for facilitating the insertion of the heating element 20 with the base section 50 through the side opening 32. The guiding element 56 and the base section 50 may have a corresponding shape such as a groove and tongue shape.

Figure 8:
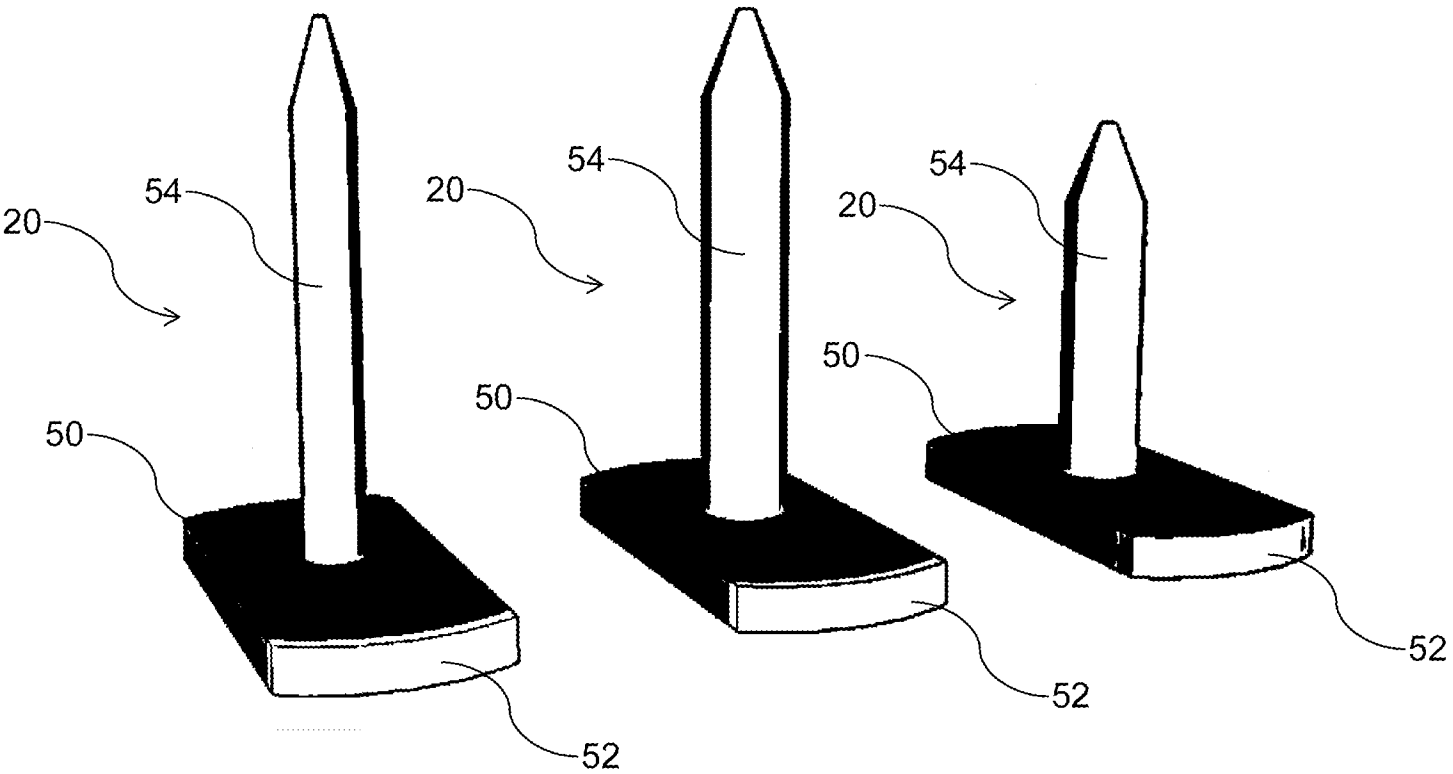
FIG. 8 shows heating elements with different lengths.

FIG. 8 shows different heating elements 20, wherein the heating elements 20 comprise heating sections 54 of different length. The different heating elements 20 can be color-coded, so that a user may identify the different heating elements by different colors of the tabs 52. The side opening 32 in the second housing portion 28 and the side opening 22 in the induction coil 18 have a sufficient length such that the different heating elements 20 can be inserted into the side openings 22, 32.

The invention is not limited to the described embodiments. The skilled person understands that the features which are described in the context of the different embodiments can be combined with each other within the scope of the invention.

The invention claimed is:

1. An aerosol-generating device, comprising:

an induction heater configured to heat an aerosol-forming substrate and comprising an induction coil and a heating element, the heating element being arrangeable within the induction coil, the induction coil comprising a first side opening along a longitudinal length of the induction coil, and the first side opening being configured to enable access to the heating element; and a housing, wherein the induction coil is arranged within the housing, and wherein the housing comprises a second side opening, which corresponds to the first side opening of the induction coil within the housing.

2. The aerosol-generating device according to claim 1, wherein the first side opening and the second side opening each have a width that is larger than a diameter of the heating element.

3. The aerosol-generating device according to claim 1, wherein the first side opening and the second side opening are configured to enable air to be drawn through the aerosol-generating device.

4. The aerosol-generating device according to claim 1, wherein the first side opening and the second side opening each have a shape configured to allow a cleaning tool to be inserted into the first side opening and the second side opening.

5. The aerosol-generating device according to claim 1, wherein the heating element is removably insertable through the first side opening and the second side opening.

6. The aerosol-generating device according to claim 1, wherein the second side opening of the housing has an inverted T-shape.

7. The aerosol-generating device according to claim 6, wherein the heating element comprises a heating section and a base section, perpendicular to the heating section, and wherein the heating element is configured to be slidably insertable through the second side opening of the housing.

8. The aerosol-generating device according to claim 7, wherein the base section of the heating element comprises a tab that remains visible after the heating element is disposed within the induction coil.

9. The aerosol-generating device according to claim 7, wherein the housing further comprises a guiding element disposed adjacent to the second side opening of the housing and being configured to guide the base section of the heating element into the housing.

10. The aerosol-generating device according to claim 7, wherein the base section is made from a thermally insulating material.

11. The aerosol-generating device according to claim 7, wherein the base section is made from an electrically non-conductive material.

12. The aerosol-generating device according to claim 1, wherein the induction coil has a C-shaped cross-section.

13. A method for manufacturing an aerosol-generating device, comprising:

providing an induction heater for heating an aerosol-forming substrate, the induction heater comprising an induction coil and a heating element, wherein the heating element is arrangeable within the induction coil, wherein the induction coil comprises a first side opening along a longitudinal length of the induction coil, wherein the first side opening is configured to enable access to the heating element; and providing a housing, wherein the induction coil is arranged within the housing, and wherein the housing comprises a second side opening, which corresponds to the first side opening of the induction coil within the housing.

14. An aerosol-generating device, comprising an induction heater configured to heat an aerosol-forming substrate, the induction heater comprising an induction coil configured to receive a heating element, the induction coil comprising a first side opening along a longitudinal length of the induction coil, wherein the first side opening is configured to enable access to the heating element received within the induction coil; and a housing, wherein the induction coil is arranged within the housing, and wherein the housing comprises a second side opening, which corresponds to the first side opening of the induction coil within the housing.

* * * * *